US012110899B2

(12) United States Patent
Cui

(10) Patent No.: US 12,110,899 B2
(45) Date of Patent: Oct. 8, 2024

(54) OSCILLATION DEVICE AND FAN

(71) Applicants: GD MIDEA ENVIRONMENT APPLIANCES MFG CO., LTD., Zhongshan (CN); MIDEA GROUP CO., LTD., Foshan (CN)

(72) Inventor: Shiqiang Cui, Zhongshan (CN)

(73) Assignees: GD MIDEA ENVIRONMENT APPLIANCES MFG CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 91 days.

(21) Appl. No.: 17/772,752

(22) PCT Filed: Jan. 8, 2020

(86) PCT No.: PCT/CN2020/071006
§ 371 (c)(1),
(2) Date: Apr. 28, 2022

(87) PCT Pub. No.: WO2021/128485
PCT Pub. Date: Jul. 1, 2021

(65) Prior Publication Data

US 2022/0372986 A1 Nov. 24, 2022

(30) Foreign Application Priority Data

Dec. 23, 2019 (CN) ..... 201911346046.8

(51) Int. Cl.
*F04D 25/10* (2006.01)
*F04D 29/053* (2006.01)

(52) U.S. Cl.
CPC ..... *F04D 25/105* (2013.01); *F04D 29/053* (2013.01)

(58) Field of Classification Search
CPC ..... F04D 25/105; F04D 29/053
See application file for complete search history.

(56) References Cited

U.S. PATENT DOCUMENTS 4,732,539 A 3/1988 Shin-Chin
5,720,594 A * 2/1998 Snow ..... F04D 25/105 416/246
2014/0369835 A1* 12/2014 Lee ..... F04D 25/105 416/100

FOREIGN PATENT DOCUMENTS

CN 201225301 Y 4/2009
CN 103671178 A 3/2014
(Continued)

OTHER PUBLICATIONS

World Intellectual Property Organization (WIPO) International Search Report and Written opinion for PCT/CN2020/071006 Sep. 17, 2020 13 Pages (Translation Included).
(Continued)

*Primary Examiner* — Sabbir Hasan
(74) *Attorney, Agent, or Firm* — Anova Law Group, PLLC

(57) ABSTRACT

The present application discloses an oscillation device and a fan, the oscillation device comprises a fixation seat provided with a through hole; a transmission shaft rotatably mounted in the through hole; and a motor mounted at the fixation seat, an output shaft of the motor being connected to an end of the transmission shaft, an axis of the output shaft of the motor being collinear with an axis of the transmission shaft, and the motor being configured to drive the transmission shaft to rotate.

17 Claims, 7 Drawing Sheets

(56) References Cited

FOREIGN PATENT DOCUMENTS

| | | | |
|---|---|---|---|
| CN | 103967818 | A | 8/2014 |
| CN | 104047873 | A | 9/2014 |
| CN | 206360911 | U | 7/2017 |
| CN | 109737084 | A | 5/2019 |
| CN | 209340190 | U | 9/2019 |
| JP | S63297796 | A | 12/1988 |
| JP | 3202959 | U | 3/2016 |
| KR | 101264581 | B1 | 5/2013 |
| KR | 20160034489 | A | 3/2016 |

OTHER PUBLICATIONS

The China National Intellectual Property Administration (CNIPA) The First Office Action for Chinese Application 201911346046.8, Oct. 29, 2021 15 Pages (With Translation).
The China National Intellectual Property Administration (CNIPA) The Second Office Action for Chinese Application 201911346046.8, Apr. 15, 2022 16 Pages (With Translation).
Korean Intellectual Property Office (KIPO) The Office Action For KR Application No. 9-5-2023-073506866 Aug. 12, 2023 11 Pages (Translation Included ).
Japan Patent Office (JPO) The Office Action For JP Application No. 2022-524644 Jul. 4, 2023 11 Pages (Translation Included).
The China National Intellectual Property Administration (Cnipa) The Grant for Chinese Application 201911346046.8, Dec. 21, 2022 5 Pages (With Translation).

* cited by examiner

OSCILLATION DEVICE AND FAN

CROSS-REFERENCE TO RELATED APPLICATION APPLICATIONS

The present application is a National Stage Entry under 35 U.S.C. § 371 of International Application No. PCT/CN2020/071006, filed on Jan. 8, 2020, which claims priority to Chinese patent application No. 201911346046.8, titled "oscillation device and fan," filed on Dec. 23, 2019, the entire contents of both of which are incorporated herein by reference.

TECHNICAL FIELD

The present application relates to the field of household appliances, in particular to an oscillation device and a fan.

BACKGROUND

In the exemplary technology, the oscillation device generally includes a oscillation motor, an oscillation shaft, a smaller gear and a bigger gear meshed with each other for transmission. The smaller gear is mounted at an output shaft of the oscillation motor, and the bigger gear is mounted at the oscillation shaft. The oscillation motor drives the oscillation shaft to rotate through the meshing of the smaller gear with the bigger gear to realize oscillation.

However, the lateral dimension of the above oscillation device (i.e. the direction perpendicular to the rotary transmission axis of the oscillation shaft) is large and occupies a large space, resulting in a large volume of the oscillation device.

SUMMARY

The main purpose of the present application is to provide an oscillation device, which aims to solve a technical problem of large transverse size of the oscillation device in the exemplary technology.

In order to achieve the above purpose, the present application provides an oscillation device comprising:

a fixation seat provided with a through hole;

a transmission shaft rotatably mounted in the through hole; and a motor mounted at the fixation seat, an output shaft of the motor being connected to an end of the transmission shaft, an axis of the output shaft of the motor being collinear with an axis of the transmission shaft, and the motor being configured to drive the transmission shaft to rotate.

Optionally, the end of the transmission shaft is provided with an irregularly-shaped hole, and a cross-section of the output shaft of the motor is irregularly-shaped and the output shaft is adaptively inserted in the irregularly-shaped hole; or the end of the transmission shaft is provided with a shaft mounting hole, the shaft mounting hole is provided with an internal spline, an outer peripheral surface of the output shaft of the motor is provided with an external spline, and the internal spline is engaged with the external spline; and the end of the transmission shaft is provided with a shaft mounting hole, the output shaft of the motor is inserted in the shaft mounting hole and connected to the shaft mounting hole through a pin.

Optionally, the oscillation device further comprises a bearing, and the transmission shaft is rotatably mounted in the through hole through the bearing; or, an inner side of the through hole is provided with an abutting circular protrusion, and the transmission shaft is rotatably mounted at an inner side of the abutting circular protrusion.

Optionally, the bearing comprises two sub-bearings provided at an interval in an axial direction of the transmission shaft.

Optionally, the transmission shaft is of a step structure, and the bearing or the abutting circular protrusion is convexly mounted at a step of the transmission shaft.

Optionally, the oscillation device further comprises a reversing assembly configured to define a preset rotation angle for reciprocating rotations of the transmission shaft.

Optionally, the reversing assembly comprises a Hall element and a magnetic element, one of the Hall element and the magnetic element is mounted at the transmission shaft, and another of the Hall element and the magnetic element is mounted at the fixation seat; and/or the preset rotation angle is at least 50 degrees; and/or the reversing assembly has a plurality of gears, and each gear corresponds to one preset rotation angle.

Optionally, the oscillation device further comprises a shaft sleeve fixedly sleeved on the transmission shaft, the magnetic element is mounted at the shaft sleeve, and the Hall element is mounted at the fixation seat.

Optionally, the transmission shaft is of a step structure, the shaft sleeve is mounted at a step of the transmission shaft, and adjacent to the bearing or the abutting circular protrusion.

Optionally, the transmission shaft is provided with a wiring hole for wiring.

Optionally, the wiring hole comprises an axial section extending in an axial direction of the transmission shaft and a radial section communicated with the axial section, the axial section piercing through an end surface of the transmission shaft away from the motor.

Optionally, a speed of the motor is larger than 0, and smaller than or equal to 25 r/min.

The present application provides a fan, comprising:

a fan box; and an oscillation device mounted in the fan box; the oscillation device comprising a fixation seat, a transmission shaft and a motor; the fixation seat being provided with a through hole; the transmission shaft being rotatably mounted in the through hole; and the motor being mounted at the fixation seat; an output shaft of the motor being connected to an end of the transmission shaft, an axis of the output shaft of the motor being collinear with an axis of the transmission shaft, and the motor being configured to drive the transmission shaft to rotate.

Optionally, the fan box is of an integrated structure, or the fan box is of split structure;

wherein an end of the fan box is provided with an opening in a length direction of the fan box, and the oscillation device is configured to slide into the fan box through the opening.

In the oscillation device of the present application, the motor and the transmission shaft are distributed in order along the axial direction of the oscillation shaft, and the motor is made to directly drive the transmission shaft to rotate (without using the transmission structure), such that it can make full use of the space occupied by the motor, so as to reduce the transverse (i.e. a direction perpendicular to the axis of the transmission shaft) size of the oscillation device, thereby realizing the miniaturization of the oscillation device, reducing the production cost, improving the manufacturability of oscillation device and the transmission efficiency.

Therefore, the oscillation device of the present application has the advantages of small volume, high transmission efficiency, low production cost, good manufacturability and the like.

BRIEF DESCRIPTION OF THE DRAWINGS

In order to more clearly explain the embodiments of the present application or the technical solutions in the existing technologies, the following will briefly introduce the drawings in the embodiments or the description of the existing technologies. It is obvious that the drawings in the following description are only some embodiments of the present application. For those skilled in the art, other drawings can be obtained according to the structure shown in these drawings without paying creative labor.

DESCRIPTION OF REFERENCE NUMERALS

Figure 1:
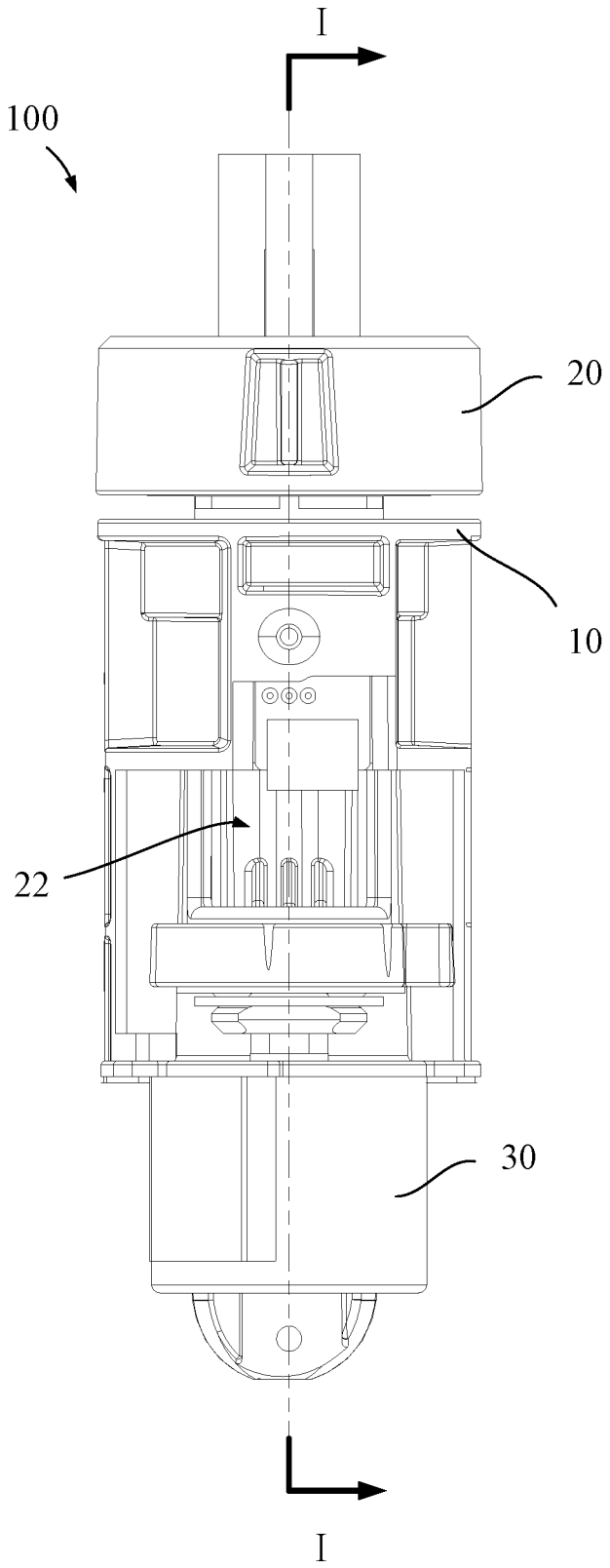
FIG. 1 is a structural diagram showing an embodiment of an oscillation device of the present application.

| Reference Numeral | Name |
|---|---|
| 100 | oscillation device |
| 10 | fixation seat |
| 11 | through hole |
| 111 | abutting circular protrusion |
| 112 | support convex part |
| 20 | transmission shaft |
| 21 | shaft mounting hole |
| 22 | wiring hole |
| 30 | motor |
| 31 | output shaft |
| 41 | Hall element |
| 42 | magnetic element |
| 50 | shaft sleeve |
| 51 | wiring through hole |
| 61 | first sub-bearing |
| 62 | second sub-bearing |
| 70 | split washer |
| a | electric connection wire |
| 1000 | fan |
| 200 | fan box |
| 201 | opening |
| 300 | fan head assembly |

The realization of the purpose, functional features and advantages of the present application will be further described with reference to the attached drawings in combination with the embodiments.

DETAILED DESCRIPTION OF THE EMBODIMENTS

The technical solution in the embodiment of the present application will be clearly and completely described below in combination with the attached drawings in the embodiment of the present application. Obviously, the described embodiments are only part of the embodiments of the present application, not all of the embodiments. Based on the embodiments in the present application, all other embodiments obtained by those skilled in the art without creative work fail in the claimed scope of the present application.

It should be understood that if there is the description of "first," "second" and so on in the present application, the description of "first," "second" and so on is only for descriptive purposes, and cannot be understood as indicating or implying their relative importance or implicitly indicating the number of indicated technical features. Thus, a feature associated with "first" or "second" may include at least one of the feature explicitly or implicitly.

In addition, the meaning of "and/or" in the full text includes three parallel solutions. Taking "A and/or B" as an example, it includes solution A, solution B, or both solutions A and B.

The present application provides an oscillation device. Specifically, the oscillation device can be used for fans and other devices. The following will take an fan as an example, which is not to limit the protection scope of the present application. When being used for fans, the oscillation device is configured to realize oscillation of a fan head assembly.

Figure 2:
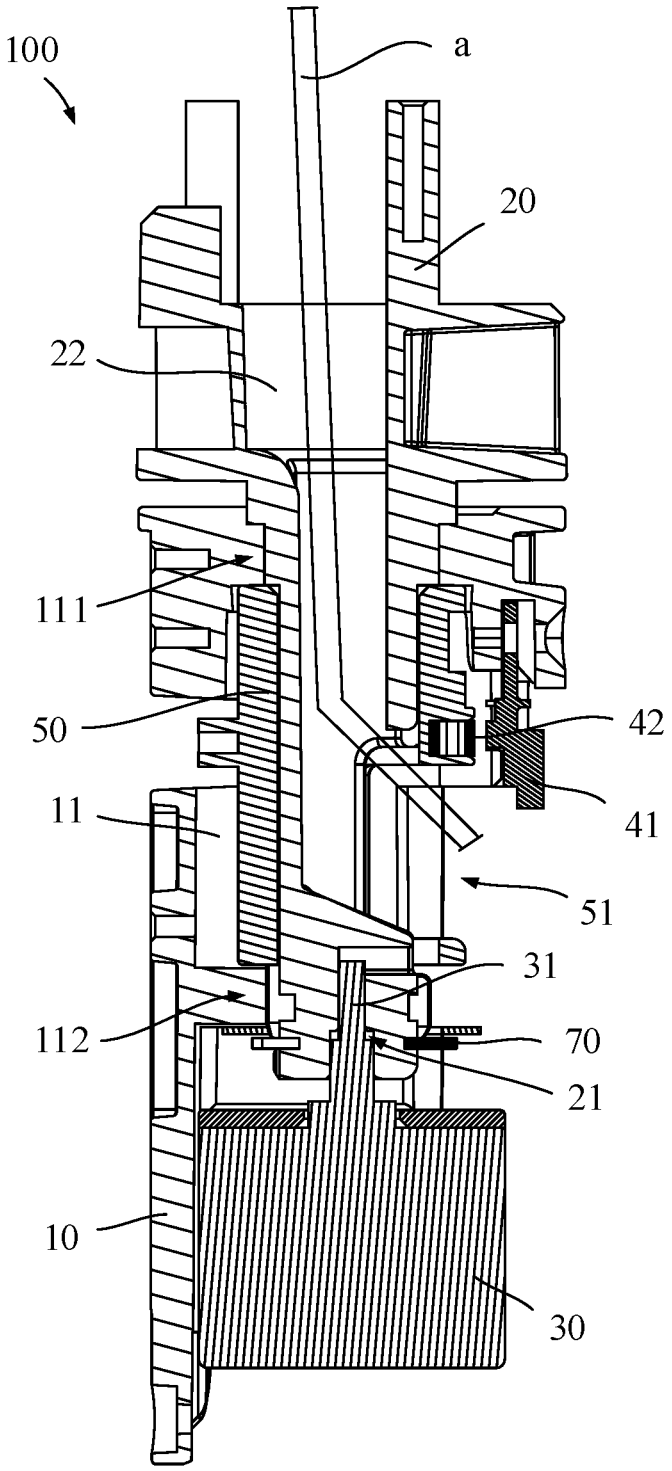
FIG. 2 is a schematic cross-sectional view of the oscillation device along line I-I in FIG. 1.

In an embodiment of the present application, as shown in FIGS. 1 and 2, the oscillation device 100 comprises:

- a fixation seat 10 provided with a through hole 11;
- a transmission shaft 20 rotatably mounted in the through hole 11; and
- a motor 30 mounted at the fixation seat 10, an output shaft 31 of the motor 30 being connected to an end of the transmission shaft 20, and an axis of the output shaft 31 of the motor 30 being collinear with an axis of the transmission shaft 20, and the motor 30 being configured to drive the transmission shaft 20 to rotate. It can be understood that the other end of the transmission shaft 20 is configured to mount the fan head assembly 300 of the fan; the motor 30 and the transmission shaft 20 are distributed in order in an axial direction of the transmission shaft 20, and the axis of the transmission shaft 20 and the axis of the output shaft 31 of the motor 30 are located in the same straight line.

Specifically, the fan head assembly 300 is mounted at the other end of the drive shaft 20. When working, the motor 30 directly drives the drive shaft 20 to rotate through the drive shaft, and the drive shaft 20 drives the fan head assembly 300 to oscillate left and right, so as to realize the fan oscillating left and right for air supply.

In the oscillation device 100 of the present application, the motor 30 and the transmission shaft 20 are distributed in order along the axial direction of the oscillation shaft, and the motor 30 directly drives the transmission shaft to rotate (without using a transmission structure), such that it can make full use of the space occupied by the motor, and reduce the transverse (i.e. the direction perpendicular to the axis of the transmission shaft) size of the oscillation device 100, thereby realizing the miniaturization of the oscillation device 100, reducing the production cost, improving the manufacturability of the oscillation device 100 and the transmission efficiency.

Therefore, the oscillation device 100 of the present application has the advantages of small volume, high transmission efficiency, low production cost, good manufacturability and the like.

Specifically, the fixation seat 10 includes a shaft mounting part (not shown) with a through hole 11 and a motor mounting part (not shown) provided at an end of the shaft mounting part and extending axially away from the shaft mounting part. The motor 30 is nakedly mounted in the motor mounting part to improve heat dissipation.

Further, as shown in FIGS. 1 and 2, an end of the transmission shaft 20 is provided with a shaft mounting hole 21, and the output shaft 31 of the motor 30 is mounted in the shaft mounting hole 21. In this way, it is convenient for the motor 30 shaft to be connected to the transmission shaft 20.

In the specific embodiments, there are many structural forms of the shaft mounting hole 21. In one embodiment, the shaft mounting hole 21 is a irregularly-shaped hole, and a shape of the cross section (at an end) of the output shaft 31 of the motor 30 is irregularly-shaped, which is adaptively inserted in the irregularly-shaped hole. The shaft mounting hole 21 is a waist-shaped hole, or the shaft mounting hole 21 includes a portion which is waist-shaped. A cross section of the end of the output shaft 31 of the motor 30 is waist-shaped, and the end of the output shaft 31 is adaptively mounted in the waist-shaped hole. In another embodiment, an inside of the shaft mounting hole 21 is provided with an internal spline, an outer peripheral surface of the output shaft 31 of the motor 30 is provided with an external spline, and the internal spline is engaged with the external spline. As another example, in another embodiment, the output shaft 31 of the motor 30 is connected to the shaft mounting hole 21 through a pin. In this way, it is convenient for the output shaft 31 of the motor 30 to drive the transmission shaft 20, so as to rotate the transmission shaft 20.

In a specific embodiment, the transmission shaft 20 can be rotatably mounted in the through hole 11 through a bearing, or the transmission shaft 20 can be rotatably mounted in the through hole 11 by a protrusion rotatably engaging with the transmission shaft 20 in the through hole 11, so as to reduce the resistance to the rotation. Those will be described in combination with other structures of transmission shaft 20 in the following.

Further, as shown in FIGS. 1 and 2, the transmission shaft 20 is a step structure. In this way, the transmission shaft 20 can be easily cooperated with other structures to facilitate positioning and limiting the transmission shaft 20.

Specifically, a smaller end of the transmission shaft 20 is connected to the output shaft 31 of the motor 30, and a larger end of the transmission shaft 20 is configured to mount the fan head assembly 300 of the fan.

Specifically, as shown in FIGS. 1 and 2, an inside of the through hole 11 is convex with an abutting circular protrusion 111, and the transmission shaft 20 is rotatably mounted at an inner side of the abutting circular protrusion 111. Thus, during the rotation of the transmission shaft 20, the abutting circular protrusion 111 can slidably abut against the transmission shaft 20 to prevent the transmission shaft 20 from oscillation during the rotation, so as to improve the rotation stability of the transmission shaft 20. At the same time, since the abutting circular protrusion 111 slidably abuts against the transmission shaft 20, a contact area of contacting with the transmission shaft 20 can also be reduced to reduce the resistance to the rotation. In addition, the production cost can be reduced.

Further, as shown in the figure, the abutting circular protrusion 111 is mounted at a step of the transmission shaft 20. In this way, it is convenient to position and limit the transmission shaft 20 during assembly.

Specifically, the abutting circular protrusion 111 is mounted at a first step of the transmission shaft 20. It should be noted that the first step of the transmission shaft 20 refers to one of steps of the transmission shaft 20. The first step is defined for ease of expression.

Optionally, a lubricant such as lubricating oil can be provided at a connecting position between the abutting convex part and the first step.

Further, as shown in FIGS. 1 and 2, the oscillation device 100 also includes a reversing assembly for defining a preset rotation angle for reciprocating rotations of the transmission shaft 20. In this way, the transmission shaft 20 can be rotated within the preset rotation angle, so that the fan head assembly 300 can rotate within the preset rotation angle.

Specifically, as shown in FIGS. 1 and 2, the reversing assembly includes a Hall element 41 and a magnetic element 42. One of the Hall element 41 and the magnetic element 42 is mounted at the transmission shaft 20 and the other of the Hall element 41 and the magnetic element 42 is mounted at the fixation seat 10.

In this embodiment, as shown in FIGS. 1 and 2, the magnetic element 42 is mounted at the transmission shaft 20, the Hall element 41 is mounted at the fixation seat 10, and the Hall element 41 is mounted close to a rotation path of the magnetic element 42.

Specifically, the Hall element 41 is electrically connected to a control element (such as an electric control board) mounted inside the product. When the oscillation device 100 works, the motor 30 drives the transmission shaft 20 and the magnetic element 42 on the transmission shaft 20 to rotate. When the magnetic element 42 rotates to a position facing the Hall element 41, the magnetic element 42 triggers the Hall element 41, and the Hall element 41 sends a trigger signal to the control element, the control element determines a rotation position of the magnetic element 42 according to the trigger signal, and the motor 30 is controlled according to the position of the magnetic element 42 to drive the transmission shaft 20 to rotate within the preset rotation angle.

The magnetic element 42 is a magnet and the Hall element 41 is a Hall plate.

In this embodiment, the Hall element 41 and the magnetic element 42 are selected as detection components of the reversing assembly. The purchase costs of the Hall element 41 and the magnetic element 42 are relatively low, which can effectively reduce the manufacturing cost of the product and realize product optimization. Of course, other elements, such as light sensing elements, can also be selected as long as the purpose of this application can be realized.

In this embodiment, optionally, the magnetic element 42 can be provided in the middle of the preset rotation angle. In this way, the transmission shaft 20 can be controlled to rotate a first preset angle in one direction after a position of the magnetic element 42 is detected, and then rotate reversely, and then control the transmission shaft 20 to rotate a second preset angle after the position of the magnetic element 42 is detected again, and then rotate reversely again, and repeats in such a way. The first preset angle is equal to the second preset angle, and the sum of the first preset angle and the second preset angle is equal to the preset rotation angle.

Optionally, the preset rotation angle is at least 50 degrees. In this way, it can be ensured that the oscillation device 100 and the fan have a certain air supply range.

Optionally, the preset rotation angle is at most 150 degrees. In this way, an air supply range of the oscillation device 100 and the fan can be prevented from being too large.

More specifically, the preset rotation angle can be at least 60 degrees and at most 120 degrees.

Further, as shown in FIGS. 1 and 2, the reversing assembly has a plurality of gears, and each gear corresponds to a preset rotation angle. In this way, the user can control a rotation range of the transmission shaft 20 of the oscillation device 100 according to the demand to control the air supply range of the fan, so as to improve the applicability of the oscillation device 100 and improve the user experience and market competitiveness.

In this embodiment, the reversing assembly has three gears, and the preset rotation angles corresponding to the three gears can be 60 degrees, 90 degrees and 120 degrees.

Specifically, the oscillation device 100 or the fan is provided with a remote controller, and the remote controller is provided with a reversing button, which can adjust the gear of the reversing assembly according to times of being pressed down.

Further, as shown in FIGS. 1 and 2, the oscillation device 100 also includes a shaft sleeve 50 fixedly sleeved on the transmission shaft 20, and the magnetic element 42 is mounted at the shaft sleeve 50. In this way, due to the shaft sleeve 50, it is convenient to mount the magnetic element 42 on the transmission shaft 20 to limit the left-most position and the right-most position of the transmission shaft 20.

Further, as shown in the figures, the shaft sleeve 50 is mounted at the step of the transmission shaft 20. In this way, it is convenient to position and limit the shaft sleeve 50 during assembly.

Further, as shown in FIGS. 1 and 2, the shaft sleeve 50 is provided at a second step of the transmission shaft 20, the first step is provided adjacent to the second step, and the shaft sleeve 50 is provided adjacent to the abutting circular protrusion 111. In this way, the compactness of the oscillation device 100 in structure can be improved, which is conducive to the miniaturization of the oscillation device 100.

Specifically, as shown in FIGS. 1 and 2, the second step is provided between the first step and the motor 30.

Further, as shown in FIGS. 1 and 2, an inner side of the through hole 11 is also provided with a support convex part 112, the shaft sleeve 50 is provided between the abutting convex part and the support convex part 112, and an end of the shaft sleeve 50 away from the abutting convex part can be abutted against the support convex part 112. In this way, the shaft sleeve 50 can be limited to limit the transmission shaft 20 in the through hole 11.

In this embodiment, the transmission shaft 20 includes four sections. As shown in FIG. 2, there are a first section, a second section, a third section and a fourth section from top to bottom, and diameters of the first section, the second section, the third section and the fourth section are reduced in turn.

The first section is provided away from a first end of the transmission shaft 20 and out of the through hole 11 to connect with the fan head assembly 300. Specifically, the first section is provided with an engagement structure connected to the fan head assembly 300.

A first step is provided between the second section and the third section.

A second step is provided between the third section and the fourth section.

Further, as shown in FIGS. 1 and 2, the transmission shaft 20 is provided with a wiring hole 22 for wiring. In this way, since an electric connection wire a is provided in the wiring hole 22 on the transmission shaft 20, the wiring in the transmission shaft 20 can be realized, and the wire passing from a periphery can be prevented, so as to prevent the connection wire a from being broken when the transmission shaft 20 rotates, and improve the reliability of the oscillation device 100 and the fan.

Specifically, the wiring hole 22 includes an axial section extending along the axial direction of the transmission shaft 20 and a radial section communicated with the axial section, the axial section passes through an end surface of the transmission shaft 20 away from the motor 30. In this way, the wiring hole 22 is L-shaped or roughly L-shaped, which can facilitate routing.

Specifically, the radial section is provided on the fourth section of the transmission shaft 20.

Specifically, the transmission shaft 20 is a hollow shaft. Optionally, the transmission shaft 20 is a integrated structure, so that the transmission shaft 20 can have high structural strength and good reliability.

Specifically, as shown in FIGS. 1 and 2, the shaft sleeve 50 is provided with a wiring through hole 51 corresponding to the radial section.

Of course, the wiring hole 22 can also be designed in other ways. For example, two ends of the wiring hole 22 extend through the two end surfaces of the transmission shaft 20 correspondingly. At this time, a sufficient distance is needed between the transmission shaft 20 and the motor 30 to facilitate wiring. For another example, the wiring hole 22 is Z-shaped, that is, an axial section is extended along the axial direction of the transmission shaft 20 and two radial sections are communicated with the axial section. The two radial sections are distributed at an interval. One of the radial sections is provided near an end of the transmission shaft 20 away from the motor 30, and the other of the radial section is provided near an end of the transmission shaft 20 close to the motor 30.

Further, as shown in FIGS. 1 and 2, the oscillation device 100 also includes a split washer 70, which is provided at the end of the transmission shaft 20 close to the motor 30, and the split washer 70 is sleeved on the transmission shaft 20 and laterally protruded from a peripheral surface of the transmission shaft 20. Specifically, the split washer 70 is provided on a side of the support convex part 112 facing the motor 30. In this way, when lifting the transmission shaft 20 upward (such as lifting the fan head assembly 300), the split washer 70 can abut against components such as the support convex part 112 to limit the axial movement of the transmission shaft 20 and prevent the transmission shaft 20 from moving along the axial direction thereof in the through hole 11.

Optionally, an annular mounting groove is provided on the peripheral surface of the transmission shaft 20, and the split washer 70 is provided in the annular mounting groove.

In a specific embodiment, the motor 30 can be provided downward, that is, the motor 30 can be provided below the fan head assembly 300. The motor 30 can also be provided upward, that is, the motor 30 can be provided above the fan head assembly 300.

In one embodiment, the motor 30 is a stepping motor 30.

In one embodiment, a speed of the motor 30 is greater than 0 and less than or equal to 25 revolutions per minute (r/min). In this way, oscillating too fast can be avoided.

In detail, a rotation speed of the motor 30 is greater than or equal to 2 r/min. In this way, oscillating too slowly can be avoided.

In more detail, a rotation speed of the motor 30 can be greater than or equal to 3 r/min and less than or equal to 15 r/min, which can make the oscillation speed of the fan more appropriate. In this embodiment, the rotation speed of the motor 30 is greater than or equal to 3 r/min and less than or equal to 10 r/min.

In one embodiment, the transmission shaft 20 is a plastic part.

Figure 3:
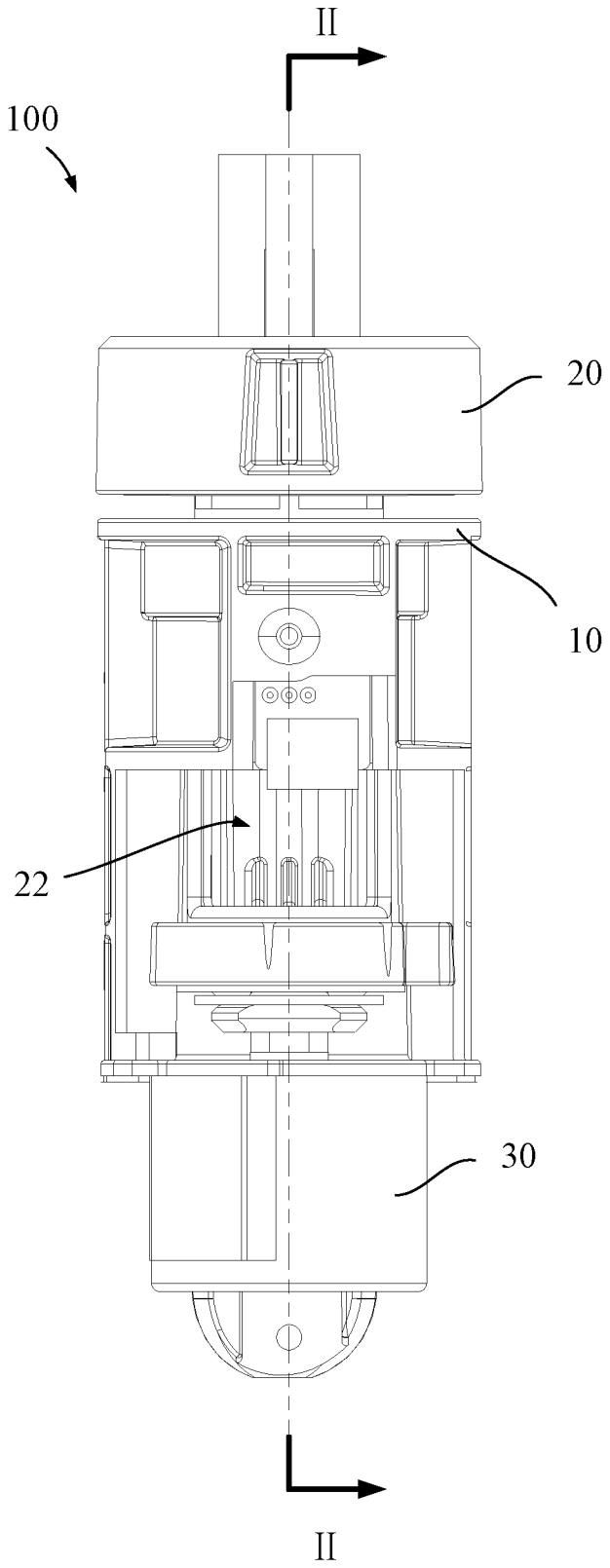
FIG. 3 is a structural diagram showing another embodiment of the oscillation device of the present application.
Figure 4:
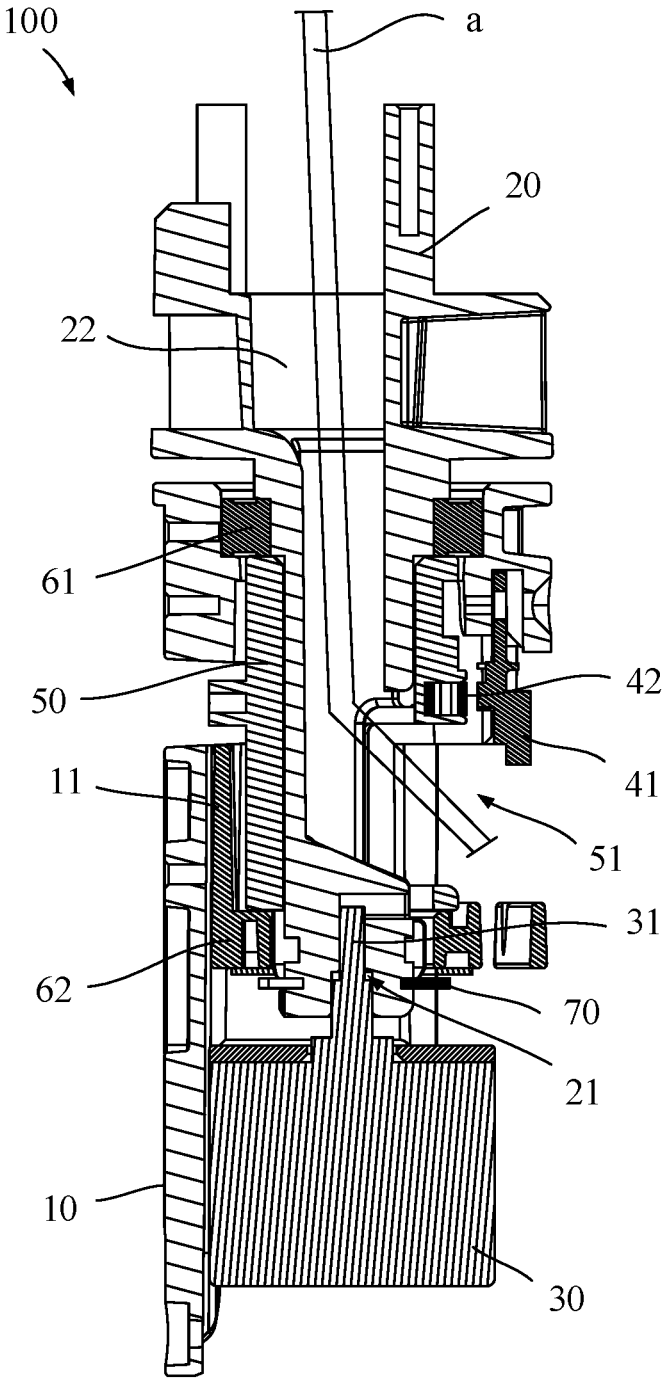
FIG. 4 is a schematic cross-sectional view of the oscillation device along line II-II in FIG. 3.
Figure 5:
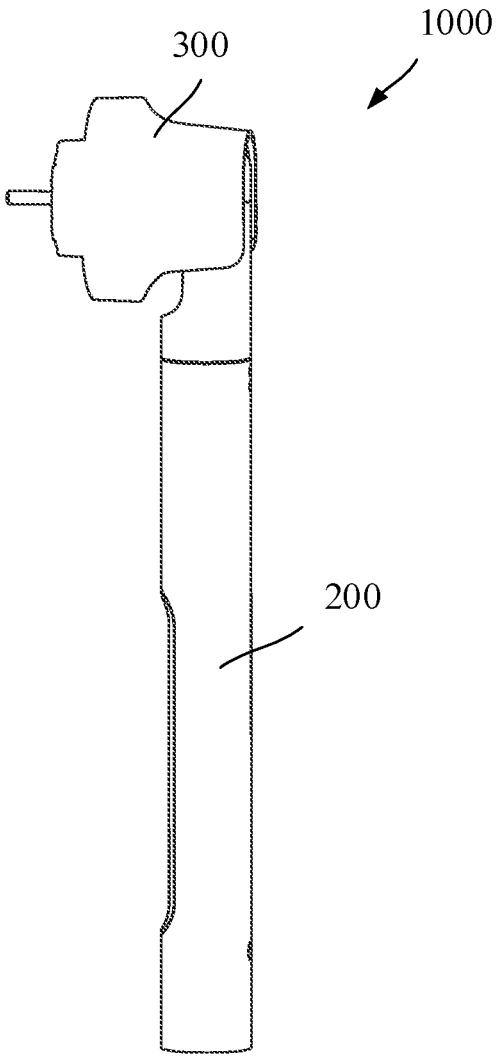
FIG. 5 is a structural diagram showing an embodiment of a fan of the present application.
Figure 6:
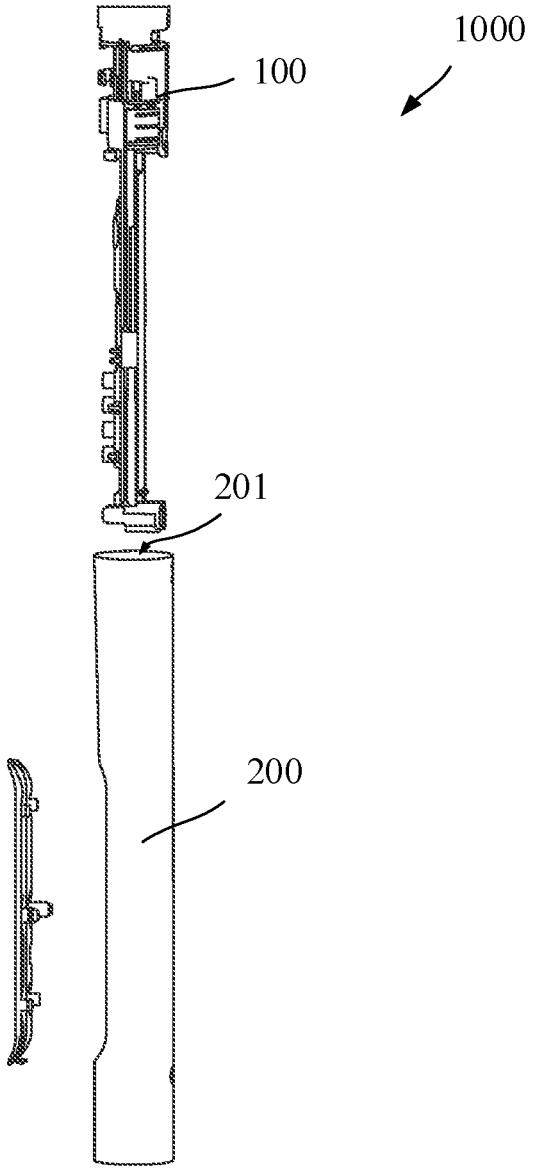
FIG. 6 is a schematic exploded view of the oscillation device and the fan box in FIG. 5.
Figure 7:
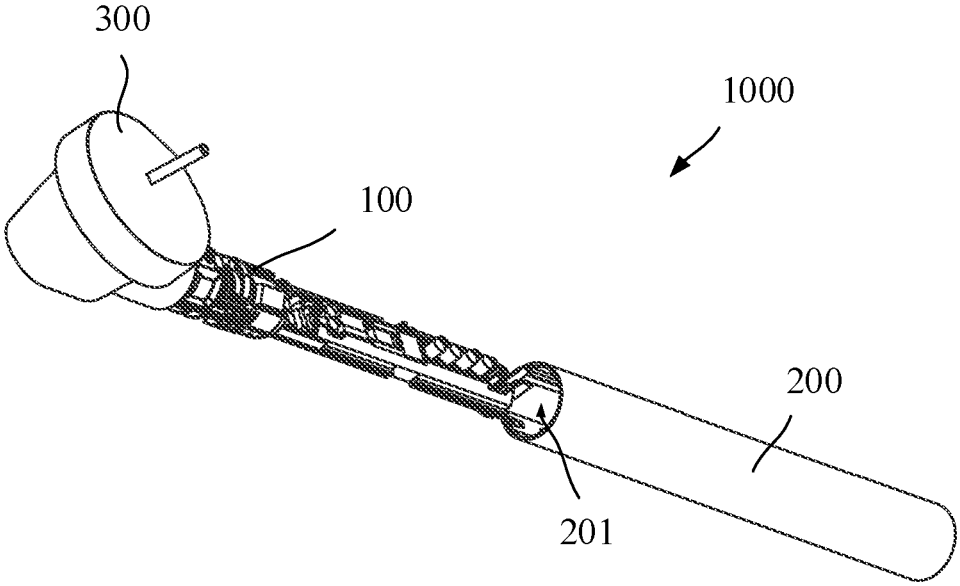
FIG. 7 is a schematic exploded view of the fan in FIG. 5.

In another embodiment of the present application, as shown in FIGS. 3 and 4, the transmission shaft 20 can be rotatably mounted in the through hole 11 by a bearing instead of the abutting convex part. In this embodiment, specifically, the oscillation device 100 also includes a bearing, and the transmission shaft 20 is rotatably mounted in the through hole 11 through the bearing. In this way, the resistance to rotation of the transmission shaft 20 can be reduced, the rotation stability of the transmission shaft 20 can be improved, and the noise can be reduced.

In this embodiment, further, as shown in the figures, the bearing includes two sub-bearings, namely a first sub-bearing 61 and a second sub-bearing 62, which are provided at an interval in the axial direction of the transmission shaft 20. In this way, due to two sub-bearings provided at an interval at the transmission shaft 20, the rotation stability of the transmission shaft 20 can be improved.

In this embodiment, further, as shown in FIGS. 3 and 4, the first sub-bearing 61 is mounted at a step of the transmission shaft 20. Thus, the first sub-bearing 61 being mounted at a step of the transmission shaft 20 makes it easy to position and limit the first sub-bearing 61 and the transmission shaft 20 during assembly.

In this embodiment, further, the bearing is mounted at the step of the transmission shaft 20. Specifically, the first sub-bearing 61 is mounted at the first step adjacent to the second step on the transmission shaft 20, and the shaft sleeve 50 is mounted adjacent to the first sub-bearing 61. In this way, the compactness of the oscillation device 100 in structure can be improved, which is conducive to the miniaturization of the oscillation device 100.

In this embodiment, specifically, as shown in FIGS. 3 and 4, an inner side of the through hole 11 is provided with a limit convex part, and the first sub-bearing 61 is provided between the limit convex part and the second section of the transmission shaft 20. Thus, during assembly, it is convenient to position and limit the first sub-bearing 61, the transmission shaft 20 and the through hole 11.

Optionally, the first sub-bearing 61 also abuts against the shaft sleeve 50.

In this embodiment, specifically, as shown in FIGS. 3 and 4, the support convex part 112 is not provided, the second sub-bearing 62 is provided at the end of the transmission shaft 20 close to the motor 30, and the shaft sleeve 50 is provided between the first sub-bearing 61 and the second sub-bearing 62.

Optionally, an end of the shaft sleeve 50 away from the first sub-bearing 61 may be abutted against the second sub-bearing 62. In this way, the compactness of the structure can also be improved.

In this embodiment, optionally, the second sub-bearing 62 is a plastic part.

In this embodiment, the assembly process of the oscillation device 100 is generally as follows: 1) the first sub-bearing 61 is mounted at the transmission shaft 20; 2) then the fixation seat 10, shaft sleeve 50, magnetic element 42, Hall element 41, second sub-bearing 62, split washer 70 and other components are assembled in turn; 3) finally, the motor 30 is fixed. Of course, another assembly sequence can either be used.

The present application also proposes a fan, which includes an oscillation device. The specific structure of the oscillation device refers to the above embodiments. Since the fan of the present application adopts all the technical schemes of all the above embodiments, it has at least all the advantages brought by the technical solution of the above embodiment, which will not be repeated here.

Further, as shown in the figure, the fan 1000 also includes a fan box 200, and the oscillation device 100 is mounted in the fan box 200. In this way, the oscillation device 100 can be protected and supported.

Further, as shown in the figures, the fan box 200 is a integrated structure. An end in a length direction of the fan box 200 is provided with an opening 201, and the oscillation device 100 is configured to slide into the fan box 200 through the opening 201. In this way, the head oscillation device 100 can be mounted quickly and conveniently. Of course, in other embodiments, the fan box 200 can also be a split structure.

Optionally, as shown in the figures, the fan 1000 also includes a fan head assembly 300. In the length direction of the fan box 200, the fan head assembly is mounted at an end of the fan box 200 and connected to the transmission shaft 20 of the oscillation device 100.

Optionally, the fan 1000 also includes a base (not shown), and the other end of the fan box 200 is mounted at the base.

Optionally, the fan 1000 also includes a control unit (not shown), which is connected to the oscillation device 100.

The above is only an optional embodiment of the present application and does not limit the scope of the patent of the present application. Any equivalent structural transformation made by using the contents of the description and drawings of the present application under the inventive concept of the present application, or directly/indirectly applied in other relevant technical fields, are included in the scope of patent protection of the present application.

The invention claimed is:

1. An oscillation device comprising:

a fixation seat provided with a through hole;

a transmission shaft rotatably mounted in the through hole; and a motor mounted at the fixation seat, an output shaft of the motor being connected to an end of the transmission shaft, an axis of the output shaft of the motor being collinear with an axis of the transmission shaft, and the motor being configured to drive the transmission shaft to rotate;

wherein the end of the transmission shaft is provided with an irregularly-shaped hole, a cross-section of the output shaft of the motor is irregularly-shaped, and the output shaft is adaptively inserted in the irregularly-shaped hole.

2. The oscillation device according to claim 1, wherein the irregularly-shaped hole is provided with an internal spline, an outer peripheral surface of the output shaft of the motor is provided with an external spline, and the internal spline is engaged with the external spline.

3. The oscillation device according to claim 1, wherein the output shaft of the motor is connected to the irregularly-shaped shaft through a pin.

4. The oscillation device according to claim 1, further comprising:

a bearing including two sub-bearings provided at an interval in an axial direction of the transmission shaft;

wherein the transmission shaft is rotatably mounted in the through hole through the bearing.

5. The oscillation device according to claim 1, wherein:

the oscillation device further comprises a bearing, and the transmission shaft is rotatably mounted in the through hole through the bearing; or an inner side of the through hole is provided with an abutting circular protrusion, and the transmission shaft is rotatably mounted at an inner side of the abutting circular protrusion.

6. The oscillation device according to claim 5, wherein the transmission shaft is of a step structure, and the bearing or the abutting circular protrusion is convexly mounted at a step of the transmission shaft.

7. The oscillation device according to claim 1, further comprising:

a reversing assembly configured to define a preset rotation angle for reciprocating rotations of the transmission shaft.

8. The oscillation device according to claim 7, wherein the reversing assembly includes a Hall element and a magnetic element, one of the Hall element and the magnetic element is mounted at the transmission shaft, and another one of the Hall element and the magnetic element is mounted at the fixation seat.

9. The oscillation device according to claim 8, further comprising:

a shaft sleeve fixedly sleeved on the transmission shaft;

wherein the magnetic element is mounted at the shaft sleeve, and the Hall element is mounted at the fixation seat.

10. The oscillation device according to claim 9, wherein:

the oscillation device further comprises a bearing and the transmission shaft is rotatably mounted in the through hole through the bearing, or an inner side of the through hole is provided with an abutting circular protrusion and the transmission shaft is rotatably mounted at an inner side of the abutting circular protrusion; and the transmission shaft is of a step structure, and the shaft sleeve is mounted at a step of the transmission shaft and adjacent to the bearing or the abutting circular protrusion.

11. The oscillation device according to claim 7, wherein the preset rotation angle is at least 50 degrees.

12. The oscillation device according to claim 7, wherein:

the reversing assembly has a plurality of gear positions and the preset rotation angle is one of a plurality of preset rotation angles; and each of the plurality of gear positions corresponds to one preset rotation angle of the plurality of preset rotation angles.

13. The oscillation device according to claim 1, wherein the transmission shaft is provided with a wiring hole for wiring.

14. The oscillation device according to claim 13, wherein the wiring hole includes:

an axial section extending in an axial direction of the transmission shaft and piercing through an end surface of the transmission shaft away from the motor; and a radial section communicated with the axial section.

15. A fan comprising:

a fan box; and the oscillation device of claim 1 mounted in the fan box.

16. The fan according to claim 15, wherein:

the fan box is of an integrated structure or a split structure;

an end of the fan box is provided with an opening in a length direction of the fan box; and the oscillation device is configured to slide into the fan box through the opening.

17. An oscillation device comprising:

a fixation seat provided with a through hole;

a transmission shaft rotatably mounted in the through hole; and a motor mounted at the fixation seat, an output shaft of the motor being connected to an end of the transmission shaft, an axis of the output shaft of the motor being collinear with an axis of the transmission shaft, and the motor being configured to drive the transmission shaft to rotate;

wherein the end of the transmission shaft is provided with a shaft mounting hole, the shaft mounting hole is provided with an internal spline, an outer peripheral surface of the output shaft of the motor is provided with an external spline, and the internal spline is engaged with the external spline.

* * * * *